US011213137B2

(12) United States Patent
Reynolds et al.

(10) Patent No.: US 11,213,137 B2
(45) Date of Patent: Jan. 4, 2022

(54) GULLWING SUITCASE COT

(71) Applicant: TRAVEL KOTS LLC, Fairburn, GA (US)

(72) Inventors: Connell E. Reynolds, Fairburn, GA (US); Jeffrey Juskowich, Murfreesboro, TN (US); Brian VanHiel, Smyrna, GA (US)

(73) Assignee: TRAVEL KOTS LLC, Fairburn, GA (US)

( * ) Notice: Subject to any disclaimer, the term of this patent is extended or adjusted under 35 U.S.C. 154(b) by 74 days.

(21) Appl. No.: 16/748,908

(22) Filed: Jan. 22, 2020

(65) Prior Publication Data

US 2021/0204705 A1 Jul. 8, 2021

Related U.S. Application Data

(60) Provisional application No. 62/956,950, filed on Jan. 3, 2020.

(51) Int. Cl.
*A47C 17/76* (2006.01)
*A47C 17/64* (2006.01)
(Continued)

(52) U.S. Cl.
CPC ..... *A47C 17/76* (2013.01); *A45C 5/03* (2013.01); *A45C 15/00* (2013.01); *A47C 17/645* (2013.01); *A47C 17/82* (2013.01)

(58) Field of Classification Search
CPC ..... A45C 5/03; A45C 15/00; A47C 17/645; A47C 17/76; A47C 17/82
See application file for complete search history.

(56) References Cited

U.S. PATENT DOCUMENTS 207,060 A * 8/1878 Morambert ..... A47C 17/68 5/114
8,806,675 B2 * 8/2014 Lah ..... A47C 19/00 5/111
(Continued)

FOREIGN PATENT DOCUMENTS

DE 102018200606 A1 * 7/2019 ..... A47C 17/645
EP 1949821 A1 * 7/2008 ..... A47C 19/04
(Continued)

*Primary Examiner* — David R Hare
*Assistant Examiner* — Alexis Felix Lopez
(74) *Attorney, Agent, or Firm* — Thomas | Horstemeyer, LLP

(57) ABSTRACT

Various embodiments for a collapsible cot are provided. A collapsible cot can include a first telescoping member, a second telescoping member, and folding support mechanisms. Each of the folding support mechanisms can include a crossmember, a first arm having a first end pivotably coupled to a first side of the crossmember and a second end slidably coupled to the first telescoping member, and a second arm having a first end pivotably coupled to a second side of the crossmember and a second end slidably coupled to the second telescoping member. The second end of the first arm and second arm can include a coupler having a cross-section having a shape and size similar to a cross-section of the first telescoping member and the second telescoping member. The coupler can permit sliding of the at least one folding support mechanism along the first and second telescoping members.

20 Claims, 9 Drawing Sheets

(51) Int. Cl.

| | |
|---|---|
| ***A45C 15/00*** | (2006.01) |
| ***A45C 5/03*** | (2006.01) |
| ***A47C 17/82*** | (2006.01) |

(56) References Cited

U.S. PATENT DOCUMENTS

| | | | | |
|---|---|---|---|---|
| 2014/0115780 | A1* | 5/2014 | Lah | A47C 19/00<br>5/111 |
| 2019/0045937 | A1* | 2/2019 | Reynolds | A47C 17/76 |

FOREIGN PATENT DOCUMENTS

| | | | | | |
|---|---|---|---|---|---|
| GB | 418440 | A | * | 10/1934 | A47C 17/76 |
| GB | 2129288 | A | * | 5/1984 | A47C 7/008 |
| KR | 101215140 | B1 | * | 1/2013 | |
| KR | 101289922 | B1 | * | 7/2013 | |

* cited by examiner

Fully Collapsed

Opening

Stretching

At Toggle

Fully Deployed

GULLWING SUITCASE COT

CROSS-REFERENCE TO RELATED APPLICATIONS

This application claims the benefit of and priority to U.S. Provisional Patent Application No. 62/956,950 entitled "GULLWING SUITCASE COT," filed Jan. 3, 2020, the contents of which being incorporated by reference in their entirety herein.

BACKGROUND

Many opportunities arise where a traveler is in need of a place to sit or lie down, such as an airport when a lack of seating or bedding is available. Airports often provide seating; however, the seating is often uncomfortable and restricts the ability to lie down comfortably.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1:
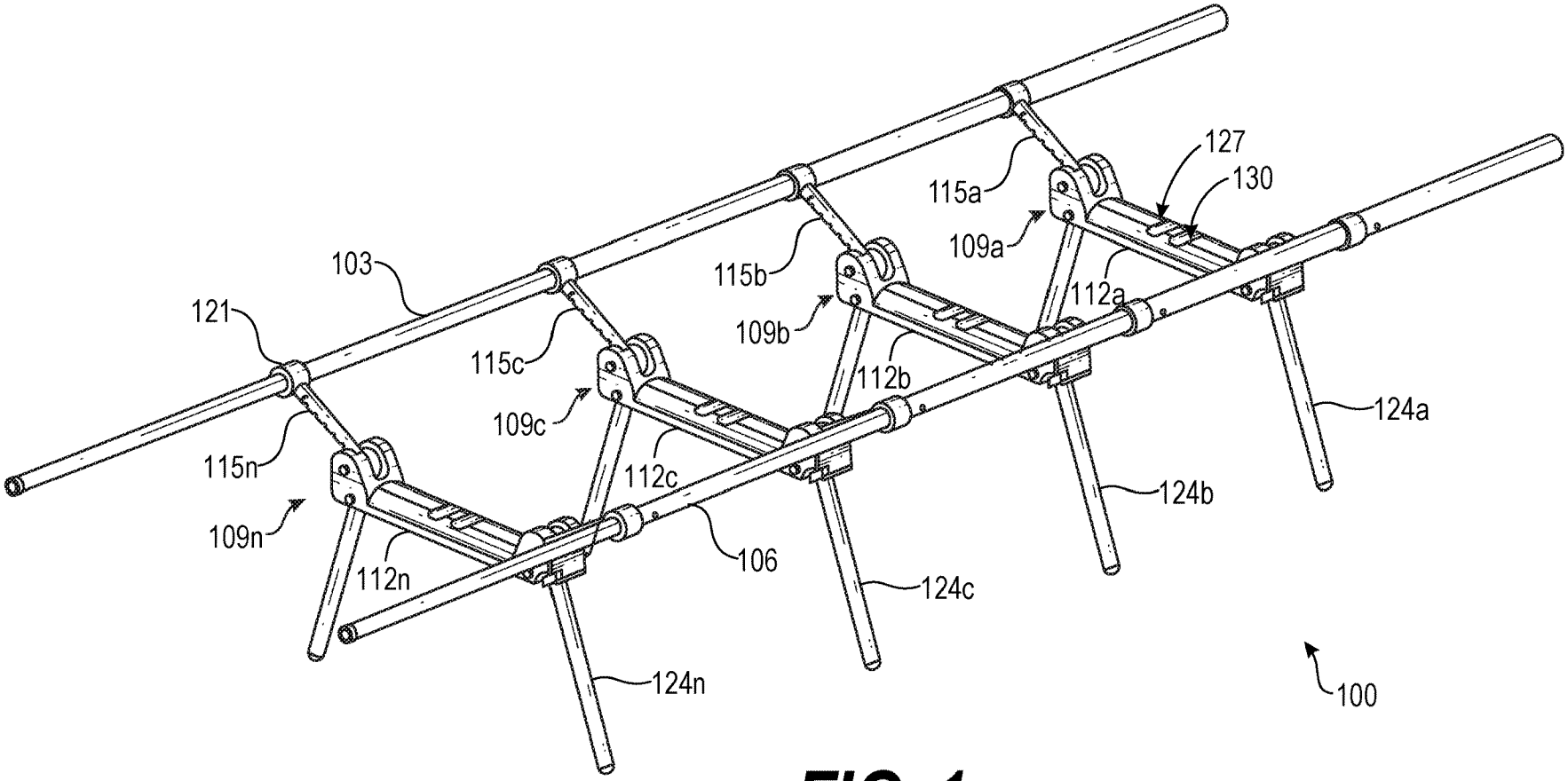
FIG. 1 is a top perspective view of a collapsible cot shown in a fully expanded state according to various embodiments of the present disclosure.

The present disclosure relates to various embodiments for a collapsible folding cot that is lightweight and can be transported using a variety forms, such as in a backpack or in luggage. In some embodiments, the folding cot or bed is attached or secured to a piece of luggage such that the cot or bed is removable or retractable from the piece of luggage. As such, in some embodiments, the collapsible folding cot weighs approximately 8 pounds (approximately 3.62 kg), however, is able to support weight of up to approximately 300 pounds (approximately 136 kg). As noted above, many opportunities arise where a traveler is in need of a place to sit or lie down, such as an airport when a lack of seating or bedding is available. Airports often provide seating; however, the seating is often uncomfortable and restricts the ability to lie down comfortably.

Accordingly, various embodiments for a collapsible cot are provided. In some embodiments, the collapsible cot can include a first telescoping member, a second telescoping member, and at least one folding support mechanism. The at least one folding support mechanism can include a crossmember, a first arm having a first end pivotably coupled to a first side of the crossmember and a second end slidably coupled to the first telescoping member, and a second arm having a first end pivotably coupled to a second side of the crossmember and a second end slidably coupled to the second telescoping member.

The second end of the first arm and the second end of the second arm can include a coupler having a cross-section, where the cross-section has a shape and size similar to a cross-section of the first telescoping member and the second telescoping member, respectively. In other words, the coupler includes an aperture having a shape and size similar to the cross-section of the first telescoping member and the second telescoping member where the first telescoping member or the second telescoping member is situated in the aperture. The coupler can permit sliding of the at least one folding support mechanism along the first telescoping member and the second telescoping member.

In some embodiments, the at least one folding support mechanism is one of a plurality of folding support mechanisms. Each of the plurality of folding support mechanisms can be configured to slide along the first telescoping member and the second telescoping member to create a separation between adjacent ones of the plurality of folding support mechanisms when in an operational state for use as a cot.

Further, in some embodiments, each of the folding support mechanisms can be configured to slide along the first telescoping member and the second telescoping member to remove separation between the adjacent ones of the folding support mechanisms when in an non-operational state for storage.

In some embodiments, the first telescoping member and the second telescoping member comprise a circular or ovular cross-section. In alternative embodiments, the first telescoping member and the second telescoping member comprise a rectangular or square cross-section.

Further, each of the plurality of folding support mechanisms can include a plurality of retractable legs configured to support a respective region of the collapsible cot. As such, the collapsible cot can include a release configured to collapse a respective one of the plurality of retractable legs. Further, each of the plurality of folding support mechanisms can include a first groove for storage of the first telescoping member and a second groove for storage of the second telescoping member when in the collapsible cot is in a collapsed state.

In some embodiments, the collapsible cot is configured to transform from a collapsed state to an expanded state for use as a cot using only two pulling motions. The collapsible cot can include a removable fabric item, where a first side of the removable fabric item is coupled to the first telescoping member and a second side of the removable fabric item is coupled to the second telescoping member. Further, in various embodiments, the collapsible cot is implemented in a luggage item, such as a rolling luggage item with wheels or a backpack. Alternatively, the collapsible cot is a stand-alone item or, in other words, not associated with a luggage item.

Referring now to FIGS. 1-12, 13A-C, 14-16, and 17A-E, a collapsible cot 100 is shown according to various embodiments. The collapsible cot 100 can include a first telescoping member 103, a second telescoping member 106, and one or more folding support mechanisms 109*a* . . . 109*n* (collectively "folding support mechanisms 109"). Referring now to a representative one of the folding support mechanisms 109*a*, a folding support mechanism 109 can include a cross-member 112. Further, each of the folding support mechanisms 109 can include a first arm 115*a* . . . 115*n* (collectively "first arms 115") and a second arm 118*a* . . . 118*n* (collectively "second arms 118"). Referring to a representative first arm 115*a*, a first arm 115 can include a first end pivotably coupled to a first side of the cross-member 112 and a second end slidably coupled to the first telescoping member 103. Further, referring to a representative second arm 118*a*, a second arm 118 can include a first end pivotably coupled to a second side of the cross-member 112 and a second end slidably coupled to the second telescoping member 106.

Figure 14:
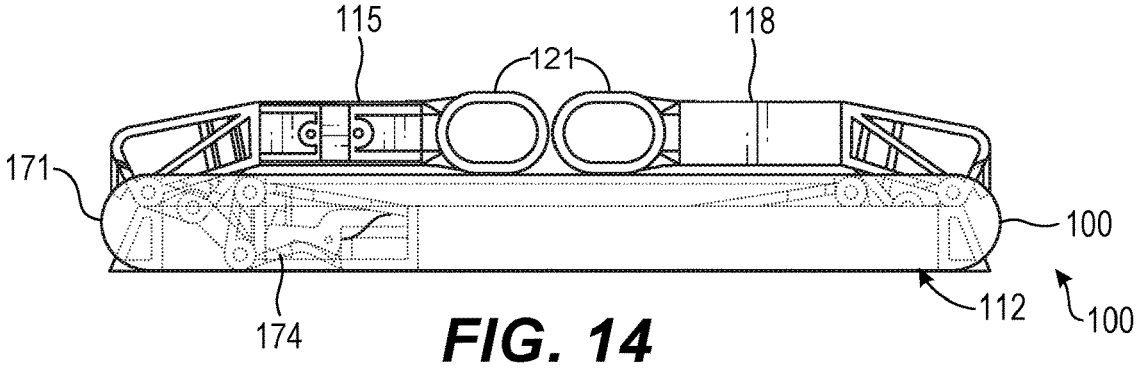
FIG. 14 is a front elevation view of the folding support mechanism shown in a fully collapsed state according to various embodiments of the present disclosure.

The second end of the first arm 115 and the second end of the second arm 118 can include a coupler 121*a*, 121*b* (collectively "couplers 121") that couples the first arm 115 and the second arm 118 to respective ones of the first telescoping member 103 and the second telescoping member 106, as can be appreciated. In some embodiments, the coupler 121 has a cross-section having a shape and size similar to a cross-section of the first telescoping member 103 and the second telescoping member 106, respectively, such that the first telescoping member 103 and the second telescoping member 106 form a slight interference fit with the coupler 121 while permitting lateral movement of the first telescoping member 103 and the second telescoping member 106, as will be described. In other words, the coupler 121 includes an aperture having a shape and size similar to the cross-section of the first telescoping member 103 and/or the second telescoping member 106, where the first telescoping member 103 or the second telescoping member 106 is slidably situated in the aperture. As such, the coupler 121 can permit sliding of the folding support mechanisms 109 along the first telescoping member 103 and the second telescoping member 106. The coupler 121 can include a circular cross-section and/or a circular aperture as shown in FIG. 1, an ovular cross-section and/or ovular aperture as shown in FIG. 14, or other suitable shapes and cross-sections. For instance, the first telescoping member 103 and the second telescoping member 106 can include a rectangular or square cross-section and/or aperture, as can be appreciated.

In some embodiments, each of the plurality of folding support mechanisms 109 can be configured to slide along the first telescoping member 103 and the second telescoping member 106, for instance, to create a separation between adjacent ones of the folding support mechanisms 109 when the collapsible cot 100 is in an operational state for use as a cot, as shown in FIG. 1. Further, in some embodiments, each of the folding support mechanisms 109 can be configured to slide along the first telescoping member 103 and the second telescoping member 106 to remove separation between the adjacent ones of the folding support mechanisms 109 when the collapsible cot 100 is in a non-operational state for storage, as shown in FIG. 3.

Figure 2:
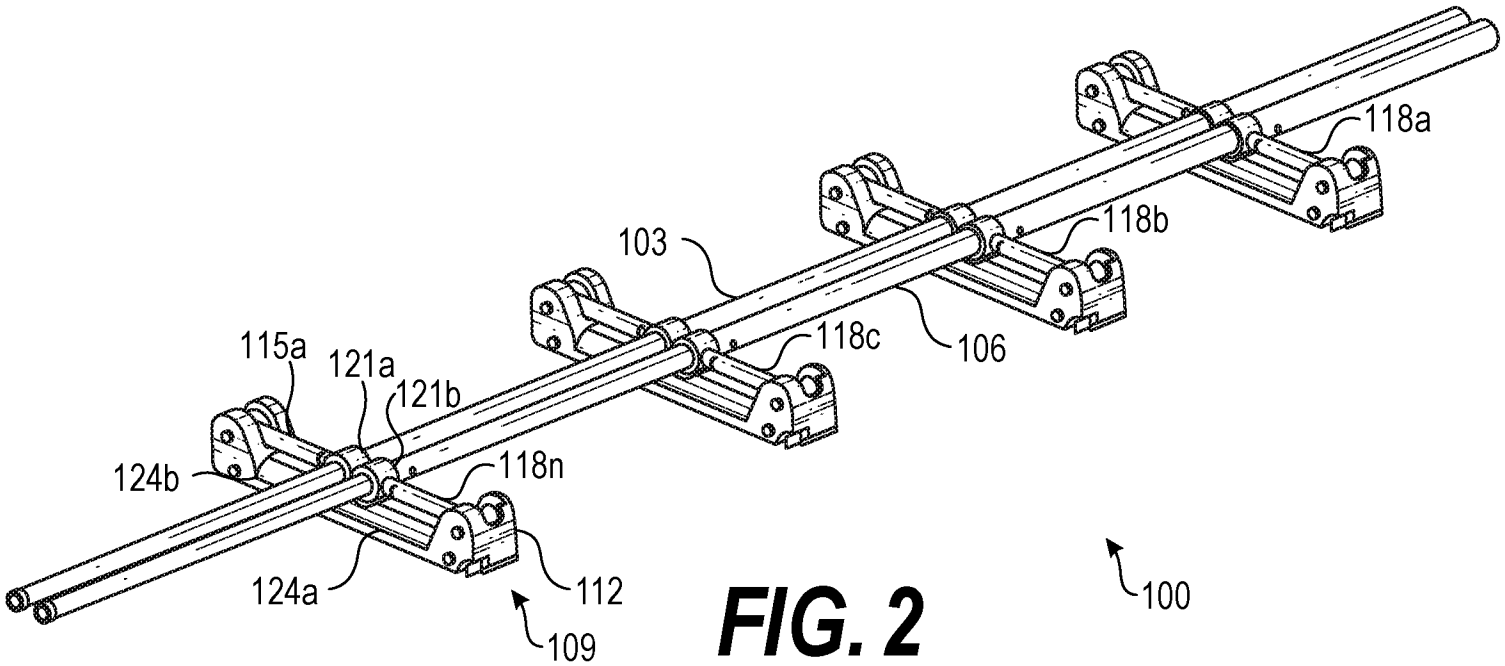
FIG. 2 is a top perspective view of the collapsible cot shown in a partially expanded state according to various embodiments of the present disclosure.
Figure 4:
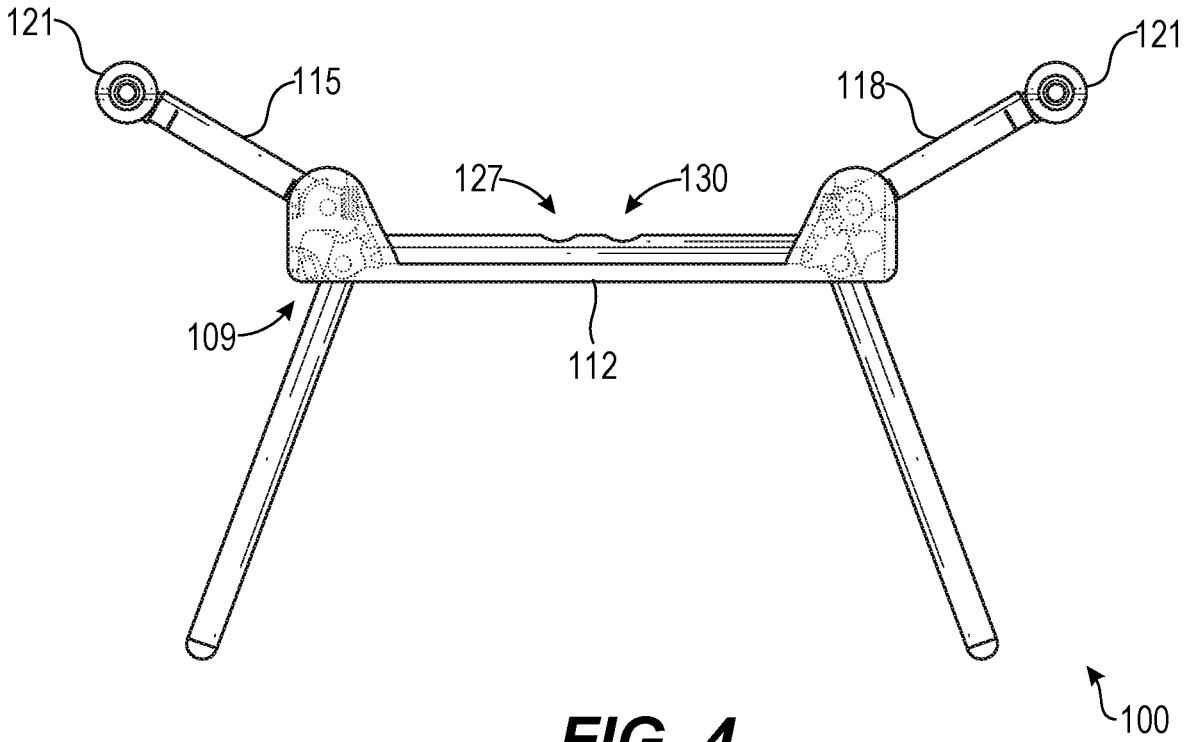
FIG. 4 is a front elevation view of the collapsible cot shown in a fully expanded state according to various embodiments of the present disclosure.

Further, each of the folding support mechanisms 109 can include a plurality of retractable legs 124*a* . . . 124*n* (collectively "retractable legs 124") configured to support a respective region of the collapsible cot 100. For instance, each of the cross-members 112 can include a pair of retractable legs 124 having a first end pivotably coupled to the cross-member 112 and a second end touching a floor or other ground surface. The collapsible cot 100 can include a plurality of releases 133 configured to pivotably collapse a respective one of the plurality of retractable legs 124, as shown in FIG. 2, where the retractable legs 124 are nested inside a bottom of the cross-member 112 of the folding support mechanisms 109. In some embodiments, when extended, the retractable legs 124 extend annularly from a respective one of the folding support mechanisms 109, as shown in FIGS. 1 and 4, such that a foot of the retractable legs 124 is positioned beyond an edge of the cross-member 112, providing additional support for the collapsible cot 100. Additionally, the first arm 115 and the second arm 118 rotate such that a width between a coupler 121 of each of the first arm 115 and the second arm 118 is wider than a width of the cross-member 112.

Further, each of the folding support mechanisms 109 can include grooves. For instance, respective ones of the folding support mechanisms 109 can include a first groove 127 for storage of the first telescoping member 103 and a second groove 130 for storage of the second telescoping member 106 when in the collapsible cot 100 is in a collapsed state. The first groove 127 and the second groove 130 can include similar or same depths in some embodiments. Further, when the collapsible cot 100 is in a collapsed state, the first telescoping member 103 and the second telescoping member 106 can be wholly or partially nested in the first groove 127 and the second groove 130, respectively. FIG. 2 shows the first telescoping member 103 and the second telescoping member 106 nested in the first groove 127 and the second groove 130, as an example.

Figure 3:
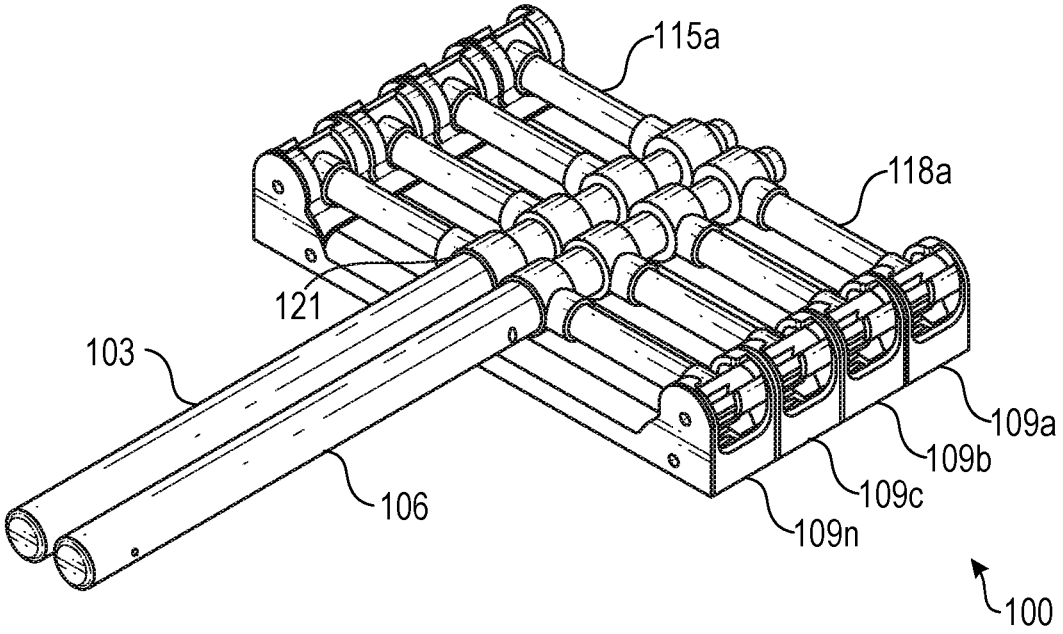
FIG. 3 is a top perspective view of the collapsible cot shown in a fully collapsed state according to various embodiments of the present disclosure.

In some embodiments, the collapsible cot 100 is configured to transform from a collapsed state (e.g., as shown in FIG. 3) to an expanded state (e.g., as shown in FIG. 1) for use as a cot using only two pulling motions, which includes expanding the first telescoping member 103 and the second telescoping member 106 using a first pulling motion and pulling the first telescoping member 103 and the second telescoping member 106 outward using a second pulling motion.

As can be appreciated, the collapsible cot 100 can include a removable fabric item (not shown) suitable for supporting weight of up to approximately three hundred pounds (or approximately 136 kg) or more, where a first side of the removable fabric item is coupled to the first telescoping member 103 and a second side of the removable fabric item is coupled to the second telescoping member 106, as can be appreciated. Further, in various embodiments, the collapsible cot 100 can be implemented in a luggage item (not shown). Alternatively, the collapsible cot 100 is a standalone item or, in other words, not associated with a luggage item.

Figure 5:
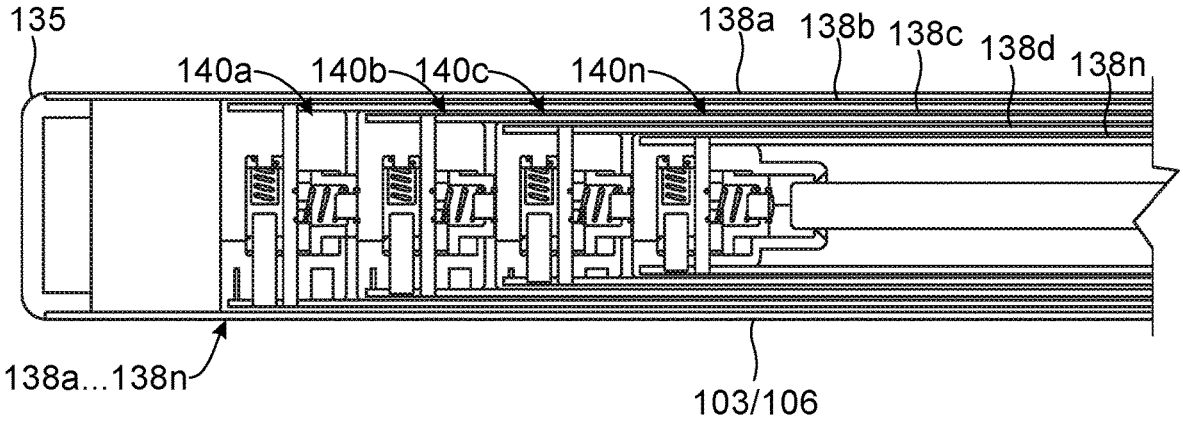
FIG. 5 is a side cross-section view of a telescoping member of the collapsible cot according to various embodiments of the present disclosure.
Figure 6A:
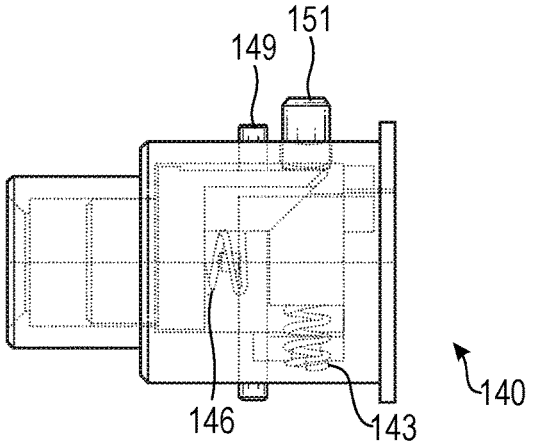
FIGS. 6A-6B are side transparent views showing pin-carrier mechanisms for telescoping the telescoping members of the collapsible cot according to various embodiments of the present disclosure.
Figure 6B:
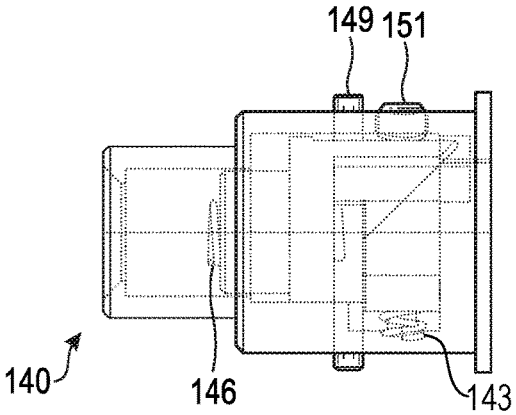

Moving on to FIG. 5, a side cross-section view of the first telescoping member 103 or, alternatively, the second telescoping member 106, of the collapsible cot 100 is shown according to various embodiments. A button 135 or other release mechanism can be positioned on a front or rear face of the telescoping member 103, 106, which may permit the telescoping member 103, 106 to telescope or otherwise move. In the embodiment of FIG. 5, FIG. 6A, and FIG. 6B, the telescoping member 103, 106 includes five tubing sections 138*a* . . . 138*n* (collectively "tubing sections 138"), although other number of tubing sections 138 can be employed. Each junction between two tubing sections 138 can include a corresponding pin-carrier mechanism 140*a* . . . 140*n*, where the pin-carrier mechanism 140 includes a vertically positioned spring 143, a horizontally positioned spring 146, a pin 149, and a projection 151 that facilitates the telescoping of the telescoping members 103, 106, as can be appreciated. FIGS. 6A-6B are side transparent views showing the pin-carrier mechanisms 140 for telescoping the telescoping members 103, 106 of the collapsible cot 100.

Figure 7:
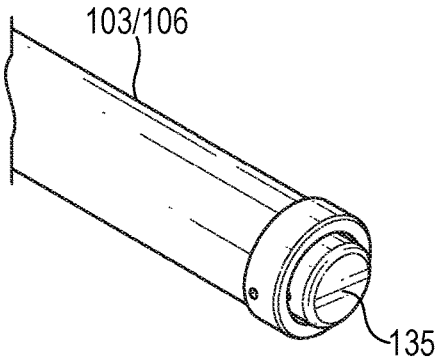
FIG. 7 is a perspective view of a distal end of the telescoping member of the collapsible cot according to various embodiments of the present disclosure.
Figure 8:
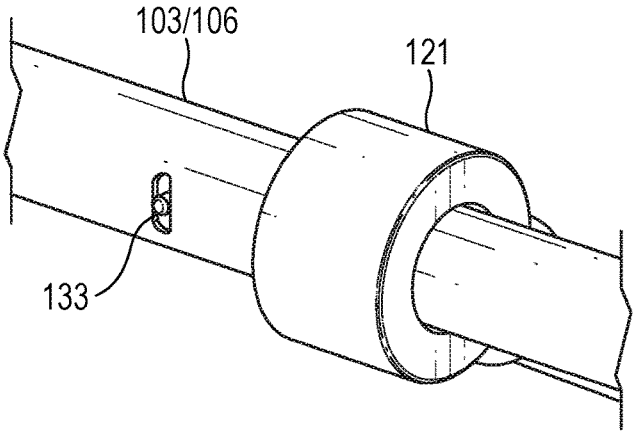
FIG. 8 is an enlarged perspective view of a coupler and a release of the collapsible cot according to various embodiments of the present disclosure.
Figure 9:
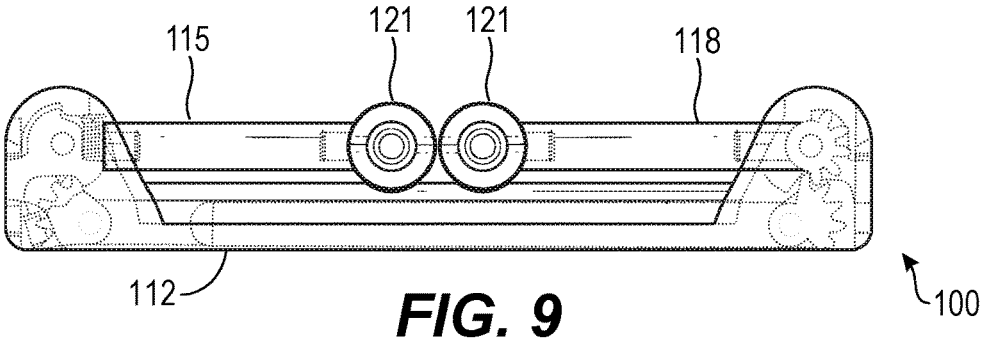
FIG. 9 is a front elevation view of a folding support mechanism of the collapsible cot shown in a fully collapsed state according to various embodiments of the present disclosure.
Figure 10:
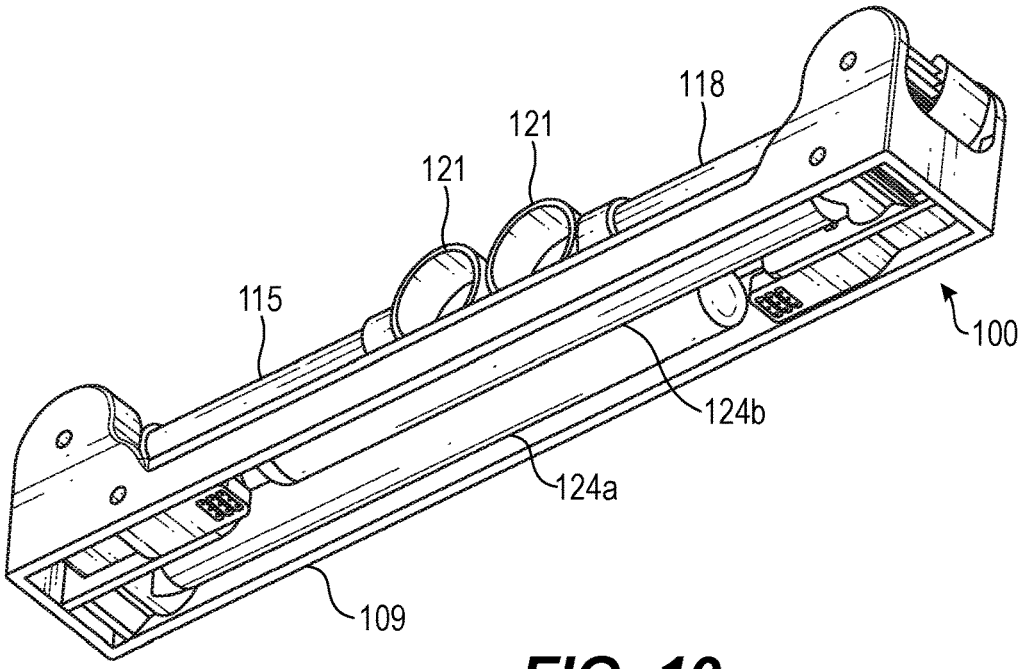
FIG. 10 is a bottom perspective view of the folding support mechanism of the collapsible cot shown in a fully collapsed state according to various embodiments of the present disclosure.

FIG. 7 is a perspective view of a distal end of the first telescoping member 103 and/or the second telescoping member 106 of the collapsible cot 100 according to various embodiments of the present disclosure. The button 135 can include a release mechanism that engages with the pin-carrier mechanisms 140 to cause the telescoping member 103, 106 to telescope or otherwise move.

Figure 11:
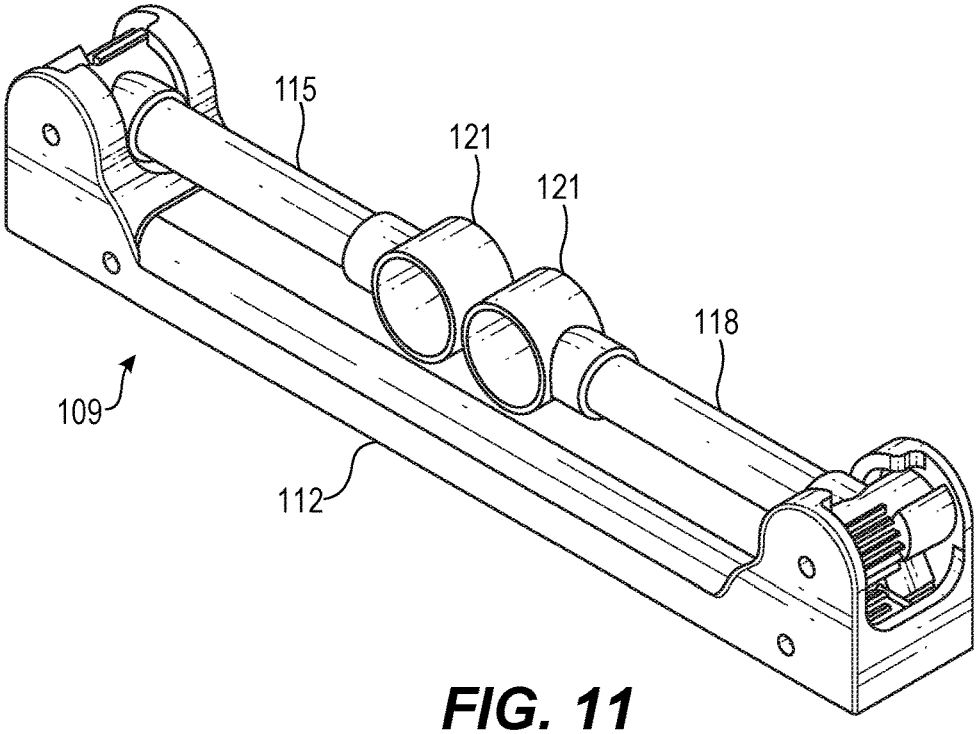
FIG. 11 is a top perspective view of the folding support mechanism of the collapsible cot shown in a fully collapsed state according to various embodiments of the present disclosure.
Figure 12:
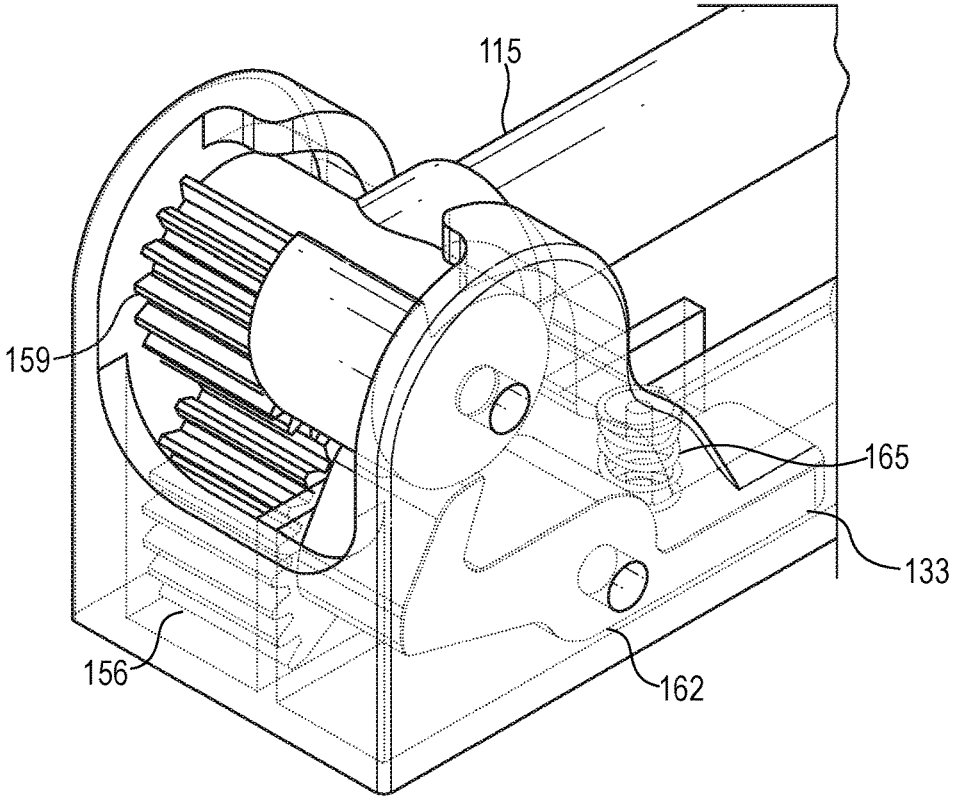
FIG. 12 is a transparent perspective view of a section of the folding support mechanism of the collapsible cot according to various embodiments of the present disclosure.

Referring next to FIG. 12, a transparent perspective view of the folding support mechanism 109 of the collapsible cot 100 is shown. In some embodiments, the folding support mechanism 109 can include a first gear 156, a second gear 159, a lever 162, and a spring 165. The first gear 156 and the second gear 159 facilitate angular movements of the first arm 115 (or the second arm 118) relative to the cross-member 112 or, in other words, the body of the folding support mechanism 109. As such, the first arm 115 and the second arm 118 are pivotably coupled to the cross-member 112. When collapsed, the components of the collapsible cot 100 are tightly collapsed, as shown in FIG. 11. However, when expanded, a projection of the lever 162 will engage with a recess in the second gear 159 to lock the first arm 115 or second arm 118 relative to the cross-member 112. A release 133 can include a bottom portion of the lever 162 that, when locked, protrudes from an aperture of the folding support mechanism 109. When the release 133 is pushed, the lever 162 is released, allowing the lever 162 to pivot relative to the folding support mechanism 109 such that the collapsible cot 100 is transitioned to the fully collapsed state. The spring 165 maintains tension during the transition and while in the fully collapsed state, and drives the annular movement of a latch 174.

Figure 13A:
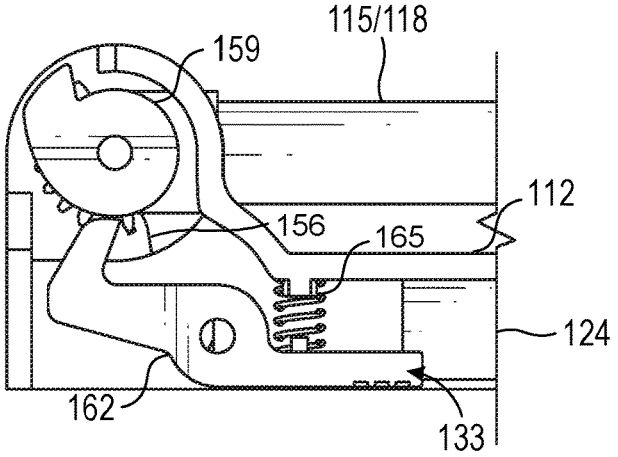
FIGS. 13A-13C are cross-section views of the folding support mechanism of the collapsible cot according to various embodiments of the present disclosure.
Figure 13B:
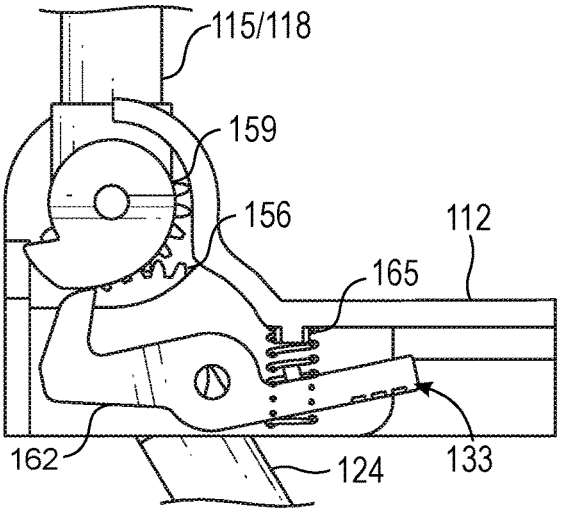
Figure 13C:
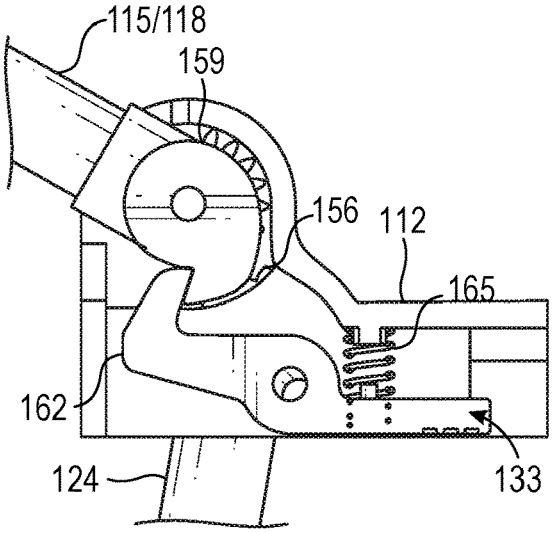

FIGS. 13A-13C are cross-section views of the folding support mechanism 109 of the collapsible cot 100 according to various embodiments of the present disclosure. FIG. 13A shows the folding support mechanism 109 and the collapsible cot 100 in a fully collapsed state. FIG. 13B shows the folding support mechanism 109 and the collapsible cot 100 transitioning to a fully expanded state. FIG. 13C shows the folding support mechanism 109 and the collapsible cot 100 in a fully expanded state. However, using the folding support mechanism 109 of this embodiment, the removable fabric item maintains a substantial amount of tension. Also, the lever 162 maintains a substantial amount of pressure when an item is supported by the collapsible cot 100, which can subject the lever 162 to breaking.

Figure 15:
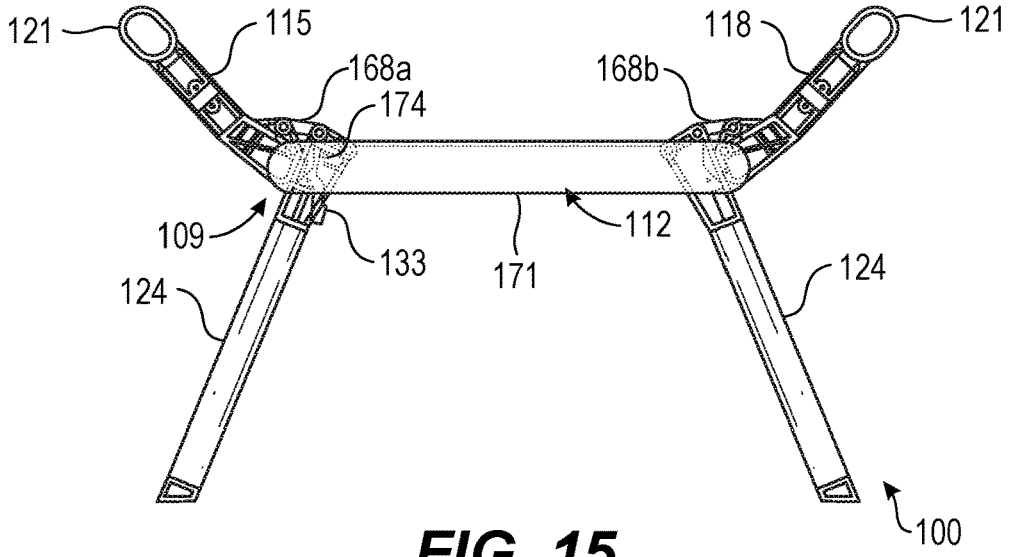
FIG. 15 is a front elevation view of the folding support mechanism shown in a fully expanded state according to various embodiments of the present disclosure.
Figure 16:
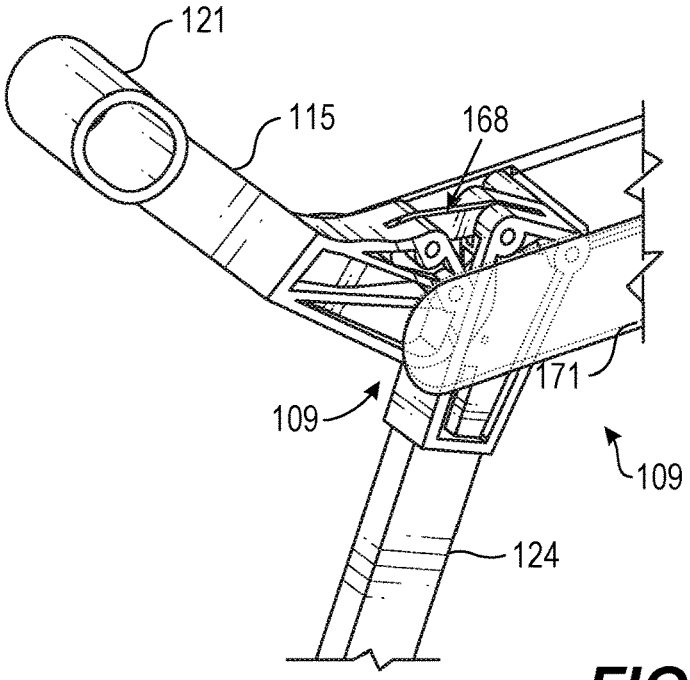
FIG. 16 is a perspective view of a section of the folding support mechanism shown in a fully expanded state according to various embodiments of the present disclosure.

FIG. 14 is a front elevation view of the folding support mechanism 109 shown in a fully collapsed state, FIG. 15 is a front elevation view of the folding support mechanism 109 shown in a fully expanded state, and FIG. 16 is a perspective view of the folding support mechanism 109 shown in a fully expanded state according to various embodiments of the present disclosure. Referring to these figures collectively, the first arm 115 and/or the second arm 118 can include a straight portion coupled directly to a coupler 121, and an angled portion pivotably coupled to the cross-member 112.

The folding support mechanism 109 further includes a link 168, a rib 171, and a latch 174. The link 168 facilitates angular movement of the first arm 115 (or the second arm 118) relative to the cross-member 112 or, in other words, the body of the folding support mechanism 109. As such, the first arm 115 and the second arm 118 are pivotably coupled to the cross-member 112. When collapsed, the components of the collapsible cot 100 are tightly collapsed, as shown in FIG. 14. However, when expanded, an aperture positioned on one side of the latch 174 will engage with a projection of a bottom portion of the first arm 115 or second arm 118 to lock the first arm 115 or second arm 118 relative to the cross-member 112. A release 133 can include a bottom portion of the latch 174 that, when locked, protrudes from an aperture of the folding support mechanism 109, as shown in FIG. 15. When the release 133 is pushed, the latch 174 is released, allowing the latch 174 to pivot relative to the folding support mechanism 109 such that the collapsible cot 100 is transitioned to the fully collapsed state.

Figure 17A:
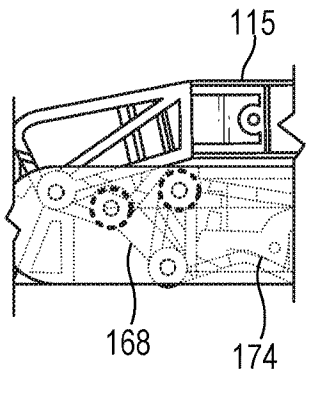
FIGS. 17A-17E are side views of a section of the folding support mechanism showing a sequence of transitioning from a fully collapsed state to a fully expanded state according to various embodiments of the present disclosure.
Figure 17B:
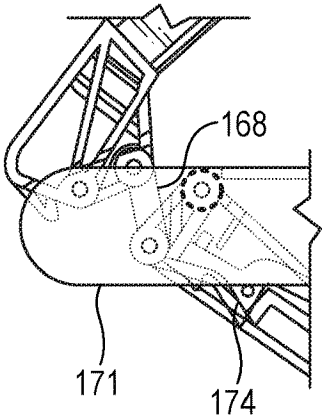
Figure 17C:
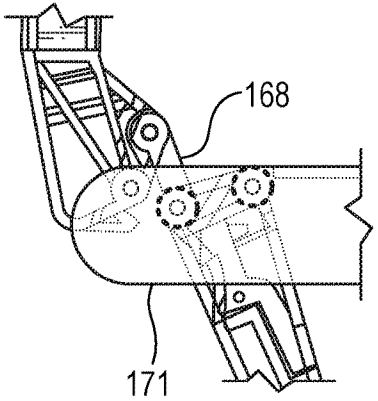
Figure 17D:
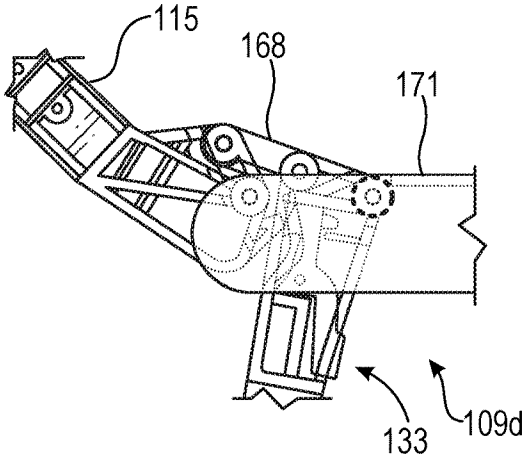
Figure 17E:
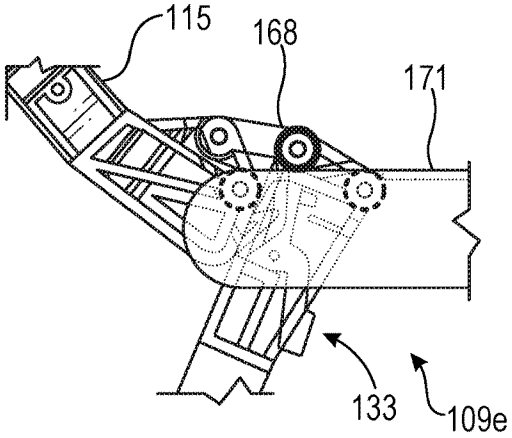

FIGS. 17A-17E are side views of a sequence of the folding support mechanism 109*a* . . . 109*e* transitioning from a fully collapsed state, shown in FIG. 17A, to a fully expanded state, shown in FIG. 17E. More specifically, FIG. 17A shows the folding support mechanism 109 in a fully collapsed state, FIG. 17B shows the folding support mechanism 109 in an opening state, FIG. 17C shows the folding support mechanism 109 in a stretching state, FIG. 17D shows the folding support mechanism 109 in an "at toggle" state, and FIG. 17E shows the folding support mechanism 109 at a fully deployed or fully expanded state.

Again, the link 168 facilitates angular movement of the first arm 115 (or, similarly, the second arm 118) relative to the rib 171 or the body of the folding support mechanism 109. When collapsed, the components of the collapsible cot 100 are tightly collapsed, as shown in FIG. 17A. However, when expanded, a hook 180 or other projection positioned on one side of the latch 174 will engage with a projection of an aperture 183 of the first arm 115 or second arm 118 to lock the first arm 115 or second arm 118 relative to the rib 171, as shown in FIG. 17E. The release 133 includes a bottom portion of the latch 174 that, when locked, protrudes from an aperture or hole of the folding support mechanism 109, as shown in FIGS. 17D and 17E. When the release 133 is pushed, the latch 174 is released, allowing the latch 174 to pivot relative to the folding support mechanism 109 such that the collapsible cot 100 is transitioned to the fully collapsed state.

It is understood that the collapsible cot 100, when converted to the cot or bed, may support an adult or child, an animal, or may be used for placement of various objects, such as clothes or other luggage. In various embodiments, the components described above can be formed of aluminum, plastic, or other light weight materials. To this end, in some embodiments, the collapsible cot 100 weights approximately 8 pounds (approximately 3.62 kg), which facilitates transport of the collapsible cot 100, and makes it convenient for use with a backpack, luggage, or other travel item.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be noted that, the embodiments and the features in the embodiments in the present application may be combined with each other to the extent possible. Terms, such as "first," "second," and so forth do not denote any order, quantity, or importance, but are merely used to distinguish different components. The terms "comprising," "including," and similar terms do not exclude other elements or items. The word "coupled, "connected," and the like are not limited to direct physical or mechanical connections, but may include connections, whether direct or indirect. Terms such as "upper," "lower," and the like are only used to indicate relative positional relationships, and when a position of a described object is changed, a relative positional relationship may also change accordingly.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A collapsible cot, comprising:

a first telescoping member;

a second telescoping member;

a plurality of folding support mechanisms connecting the first telescoping member and the second telescoping member positioned apart from one another in an expanded state, each of the plurality of folding support mechanisms, comprising:

a crossmember;

a first arm having a first end pivotably coupled to a first side of the crossmember and a second end coupled to the first telescoping member;

a second arm having a first end pivotably coupled to a second side of the crossmember and a second end coupled to the second telescoping member;

a first retractable leg pivotably coupled to the first side of the crossmember; and a second retractable leg pivotably coupled to the second side of the crossmember, the first retractable leg and the second retractable leg being configured to pivot into and nest at least partially inside a bottom of the cross-member;

a release mechanism that, in response to a manipulation, causes a plurality of tubing sections of the first telescoping member and the second telescoping member to telescope from the expanded state into a collapsed state in which the plurality of folding support mechanisms are positioned adjacent to one another, and the collapsed state further comprising the first telescoping member and the second telescoping member being positioned, through a pivoting of the first arm and second arm of each of the plurality of folding support mechanisms, to reside between the first end and the second end of each of the plurality of folding support mechanisms.

2. The collapsible cot of claim 1, wherein:

the second end of the first arm and the second end of the second arm each comprise a coupler having an aperture with a shape and size similar to a cross-section of the first telescoping member and the second telescoping member, respectively.

3. The collapsible cot of claim 1, wherein the first telescoping member and the second telescoping member comprise a circular or ovular cross-section.

4. The collapsible cot of claim 1, wherein:

the first retractable leg and the second retractable leg are two of a plurality of retractable legs; and the collapsible cot further comprises a release configured to collapse each of the plurality of retractable legs.

5. The collapsible cot of claim 1, wherein each of the plurality of folding support mechanisms comprises a first groove for storage of the first telescoping member and a second groove for storage of the second telescoping member when the collapsible cot is in the collapsed state.

6. The collapsible cot of claim 1, wherein the collapsible cot is configured to transform from the collapsed state to the expanded state for use as a cot using only two pulling motions.

7. The collapsible cot of claim 1, further comprising a removable fabric item, a first side of the removable fabric item being coupled to the first telescoping member and a second side of the removable fabric item being coupled to the second telescoping member.

8. The collapsible cot of claim 1, wherein the collapsible cot is implemented in a luggage item.

9. The collapsible cot of claim 1, wherein each junction of the plurality of tubing sections comprise a corresponding pin-carrier mechanism comprising a vertically positioned spring, a horizontally positioned spring, a pin, and a projection that facilitate telescoping of the first telescoping member and the second telescoping member.

10. The collapsible cot of claim 1, wherein connections between the first arm to the crossmember and the second arm to the crossmember each comprise a first gear and a second gear that facilitates angular movement of a respective one of the first arm and the second arm relative to the crossmember.

11. A method, comprising:

providing a collapsible cot, comprising:

a first telescoping member;

a second telescoping member;

a plurality of folding support mechanisms connecting the first telescoping member and the second telescoping member positioned apart from one another in an expanded state, each of the plurality of folding support mechanisms, comprising:

a crossmember;

a first arm having a first end pivotably coupled to a first side of the crossmember and a second end coupled to the first telescoping member;

a second arm having a first end pivotably coupled to a second side of the crossmember and a second end coupled to the second telescoping member;

a first retractable leg pivotably coupled to the first side of the crossmember; and a second retractable leg pivotably coupled to the second side of the crossmember, the first retractable leg and the second retractable leg being configured to pivot into and nest at least partially inside a bottom of the cross-member;

a release mechanism that, in response to a manipulation, causes a plurality of tubing sections of the first telescoping member and the second telescoping member to telescope from the expanded state into a collapsed state in which the plurality of folding support mechanisms are positioned adjacent to one another, and the collapsed state further comprising the first telescoping member and the second telescoping member being positioned, through a pivoting of the first arm and second arm of each of the plurality of folding support mechanisms, to reside between the first end and the second end of each of the plurality of folding support mechanisms.

12. The method of claim 11, wherein:

the second end of the first arm and the second end of the second arm comprises a coupler having a cross-section having a shape and size similar to a cross-section of the first telescoping member and the second telescoping member, respectively.

13. The method of claim 11, wherein the first telescoping member and the second telescoping member comprise a circular or ovular cross-section.

14. The method of claim 11, wherein:

the first retractable leg and the second retractable leg are two of a plurality of retractable legs; and the collapsible cot further comprises a release configured to collapse each of the plurality or retractable legs.

15. The method of claim 11, wherein each of the plurality of folding support mechanisms comprises a first groove for storage of the first telescoping member and a second groove for storage of the second telescoping member when the collapsible cot is in the collapsed state.

16. The method of claim 11, wherein the collapsible cot is configured to transform from collapsed state to the expanded state for use as a cot using only two pulling motions.

17. The method of claim 11, further comprising providing a removable fabric item, a first side of the removable fabric item being coupled to the first telescoping member and a second side of the removable fabric item being coupled to the second telescoping member.

18. The method of claim 11, further comprising implementing the collapsible cot in a luggage item.

19. The method of claim 11, wherein, in the retracted state:

the plurality of folding support mechanisms are positioned adjacent to one another towards top ends of the first telescoping member and the second telescoping member; and bottom ends of the first telescoping member and the second telescoping member extend out beyond a bottom-most one of the plurality of folding support mechanisms.

20. The method of claim 11, wherein the release mechanism is a button positioned on a face of at least one of the first telescoping member and the second telescoping member.

* * * * *